United States Patent [19]

Humphreys

[11] 4,136,713

[45] Jan. 30, 1979

[54] HYDRAULIC CIRCUIT UNITS

[75] Inventor: Geoffrey Humphreys, London, England

[73] Assignee: B & G Hydraulics Limited, Worthing, England

[21] Appl. No.: 671,497

[22] Filed: Mar. 29, 1976

[30] Foreign Application Priority Data

Apr. 1, 1975 [GB] United Kingdom ..... 13347/75

[51] Int. Cl.[2] ..... F15C 4/00

[52] U.S. Cl. ..... 137/561 A; 132/884; 137/270

[58] Field of Search ..... 137/269, 270, 270.5, 137/271, 561 A, 608, 884

[56] References Cited

U.S. PATENT DOCUMENTS

| | | | |
|---|---|---|---|
| 3,357,444 | 12/1967 | Zeuner | 137/270 |
| 3,384,114 | 5/1968 | Hathaway et al. | 137/608 |
| 3,400,732 | 9/1968 | Larrabee | 137/608 |
| 3,503,414 | 3/1970 | Schnellmann | 137/608 |
| 3,602,247 | 8/1971 | Bunn et al. | 137/270 |
| 3,654,960 | 4/1972 | Kiernan | 137/271 |
| 3,658,088 | 4/1972 | Jensen et al. | 137/608 |
| 3,661,166 | 5/1972 | Dickason | 137/269 |
| 3,677,577 | 7/1972 | Krauer et al. | 137/269 |
| 3,680,589 | 8/1972 | Jeans et al. | 137/271 |
| 3,756,274 | 9/1973 | Wolfgramm | 137/561 A |
| 3,765,441 | 10/1973 | Chang | 137/271 |
| 3,840,047 | 10/1974 | Gibbins | 137/608 |
| 3,879,068 | 4/1975 | Stampfli | 137/271 |
| 3,886,638 | 6/1975 | Hayman et al. | 137/561 A |
| 3,891,003 | 6/1975 | Duttarer | 137/608 |
| 3,993,091 | 11/1976 | Loveless | 137/608 |

*Primary Examiner*—William R. Cline
*Assistant Examiner*—H. Jay Spiegel
*Attorney, Agent, or Firm*—Young & Thompson

[57] ABSTRACT

A hydraulic circuit unit comprises parallel top and bottom faces and a side face for receiving a valve assembly. At least four passageways extend between the top and bottom faces and are perpendicular to them. The ends of the passageways open through the faces and the passageways are arranged with one at the center of a circle and the others regularly spaced around the circumference of the circle so that the unit may be rotated about the center of the circle to align the passageways with those of an adjacent similar unit in a plurality of positions. Connections extend between at least two of the passageways and a valve assembly positioned on the side face.

11 Claims, 36 Drawing Figures

HYDRAULIC CIRCUIT UNITS

This invention relates to hydraulic circuit units and is particularly, though not exclusively, concerned with a hydraulic circuit unit suitable for use in constructing modular hydraulic circuits.

The invention provides a hydraulic circuit unit comprising, in a particular orientation thereof, parallel top and bottom faces, at least one side face for receiving or for attachment of a valve assembly, at least four passageways extending between the top and bottom faces and perpendicular to the faces, the said passageways having their ends opening through the faces, and connections for extending between a valve assembly when positioned on the side face and at least two of the passageways, in which the passageways are arranged with one at the center of a circle and the other passageways regularly spaced around the circumference of the circle so that the unit may be rotated about the center of the circle to align the passageways with the passageways of an adjacent similar unit in a plurality of positions.

Although the unit has been described as having top and bottom faces, these faces may in use be positioned at two sides of the unit, for example, when the unit is included in a horizontally extending valve stack.

The valve assembly may be any conventional valve assembly, for example, a sub-plate mounted valve.

Preferably there are five passageways, said passageways consisting of a central passageway and four similar passageways arranged symmetrically around the circumference of a circle with the central passageway at its center.

Preferably each of the top and bottom faces of the unit is cooperable with either the top face or the bottom face of an adjacent similar unit to align the passageways with the passageways of the adjacent unit in four positions so that eight relative orientations of the passageways of the two blocks may be obtained.

The side faces of the unit may be perpendicular to the top and bottom faces.

In one embodiment the unit comprises a cast block and the passageways and connections comprise bores formed in the block.

In another embodiment the top, bottom and valve-mounting faces of the unit each comprise a plate and the passageways comprise pipes extending between the top and bottom plates and having their ends opening through the plates.

The invention also provides a hydraulic circuit comprising at least two hydraulic circuit units as described above when operatively connected together.

Preferably, at least one of the hydraulic circuit units has a valve assembly operatively connected to its valve-mounting face.

Preferably releasable connecting means are provided for connecting adjacent units together and preferably these are tie bolts.

Sealing means may be provided between adjacent units and a base unit, a cap unit and other auxiliary units may be included in the hydraulic circuit.

Further features and advantages of the invention will become apparent from the following description, by way of example, of some preferred embodiments of hydraulic circuit units according to the invention, together with some embodiments of auxiliary apparatus, the description being made with reference to the accompanying drawings, in which.

Figure 1:
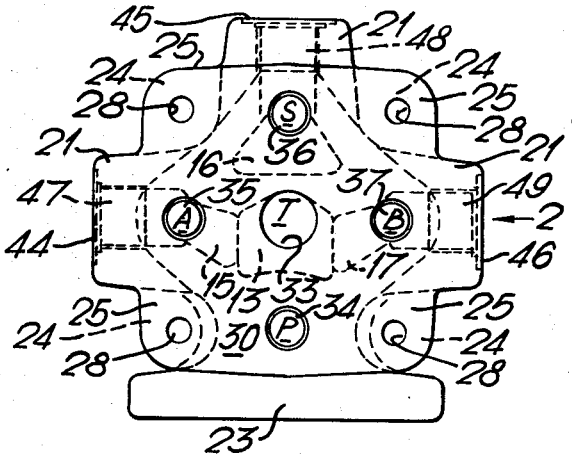
FIG. 1 is a plan view of the basic hydraulic circuit unit of the invention with the connections to the valve-mounting face omitted.
Figure 4A:
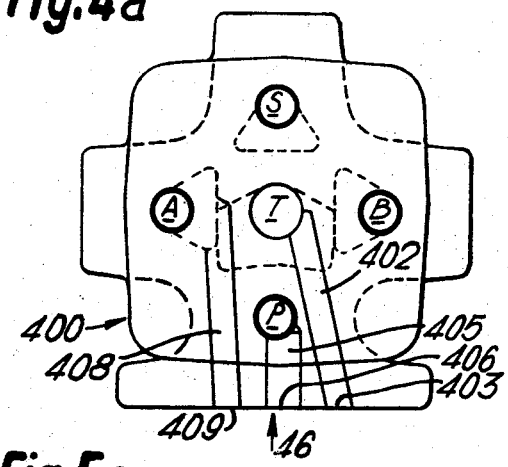
Figure 4B:
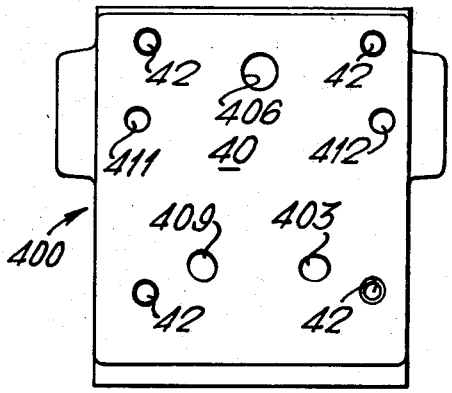

FIG. 4*a* is a diagrammatic view similar to FIG. 1 and showing the connections to the valve-mounting face of a unit for mounting a 3-port flow control valve;

FIG. 4*b* is an elevation view looking in the direction of arrow 4*b* of FIG. 4*a* and showing the valve mounting face of the hydraulic circuit unit of FIG. 4*a;*

Figure 5A:
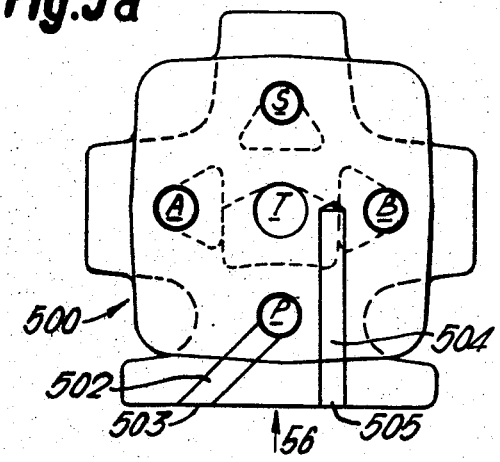
Figure 12A:
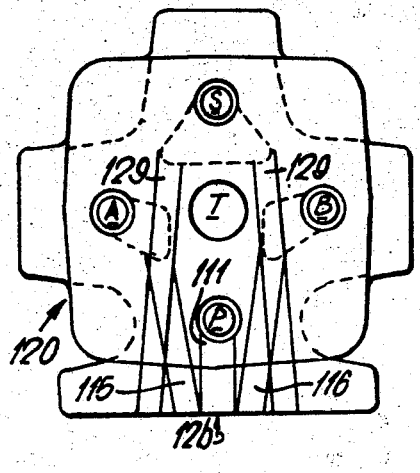
Figure 12B:
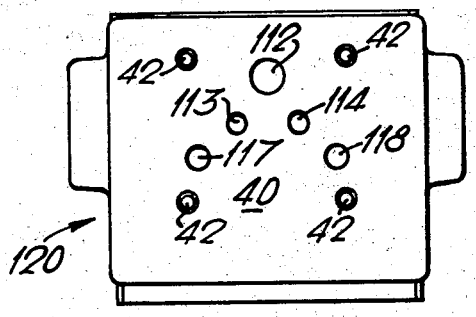
Figure 15A:
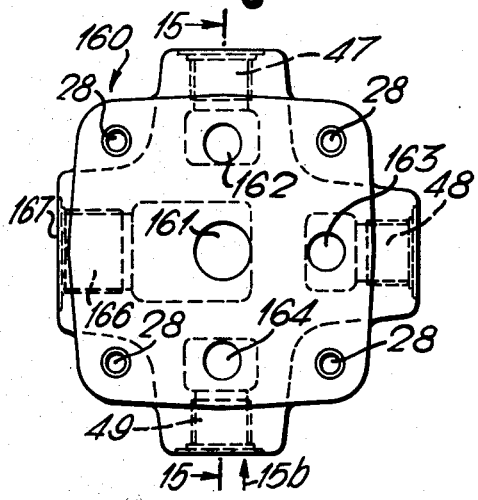
Figure 15B:
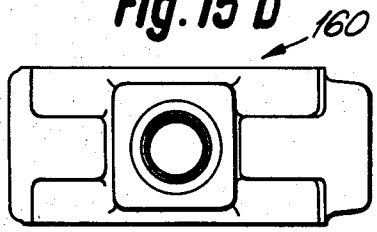
Figure 15C:
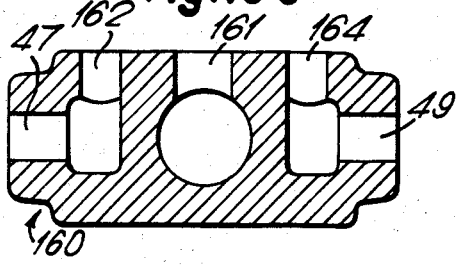
Figure 13A:
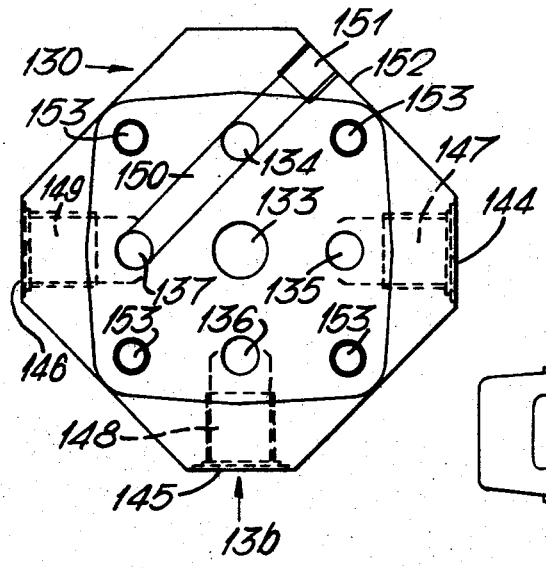
Figure 13B:
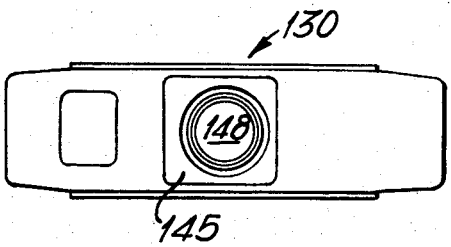
Figure 14A:
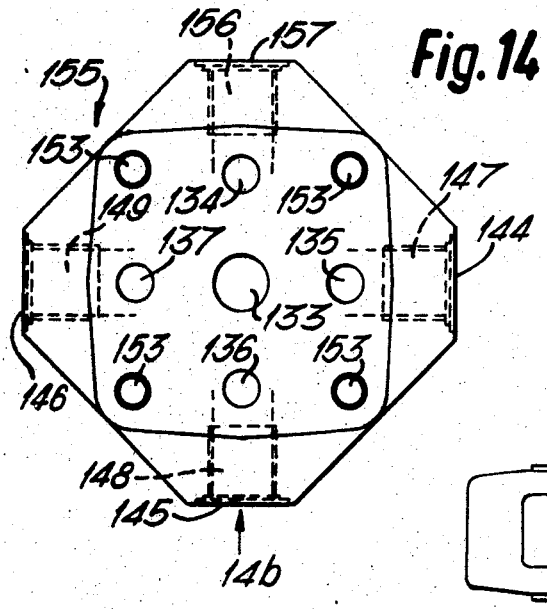
Figure 14B:
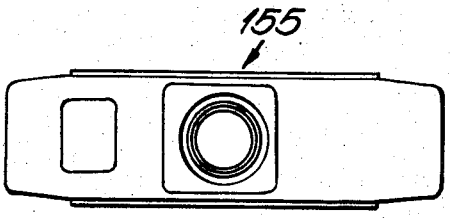

FIGS. 5*a* and 12*b* are views similar to FIG. 4 of units for mounting other standard valves, these being respectively: a 2-port flow control valve, a relief valve, a pilot-operated check, sequence or pressure reducing valve, a fine control valve, a check valve, a port lock valve, a solenoid valve for connection in a parallel circuit and a solenoid valve for connection in a parallel circuit and a solenoid valve for connection in a series circuit;

FIGS. 13*a* and 13*b* are respectively a plan view and an elevation in the direction of arrow 13*b* of a 90° change-over unit;

FIGS. 14*a* and 14*b* are respectively a plan view and an elevation in the direction of arrow 14*b* of a porting unit;

FIGS. 15*a* and 15*b* are respectively a plan view and an elevation in the direction of arrow 15*b* of a base unit;

FIG. 15*c* is a section along the line 15—15 of FIG. 15*a;*

Figure 2:
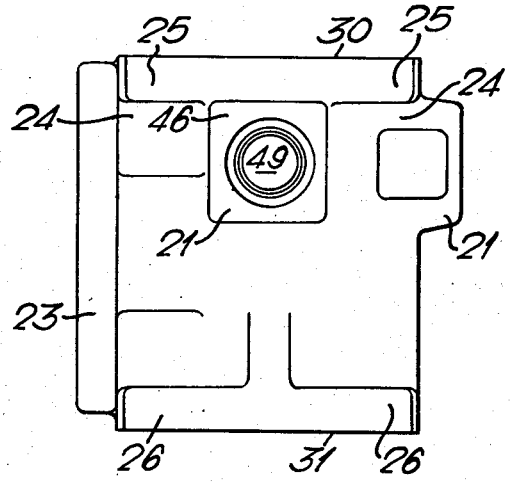
FIGS. 2 and 3 are respectively elevation views looking in the direction of arrow 2 in FIG. 1 of a large and a small unit, the plan views of which are as shown in FIG. 1.
Figure 3:
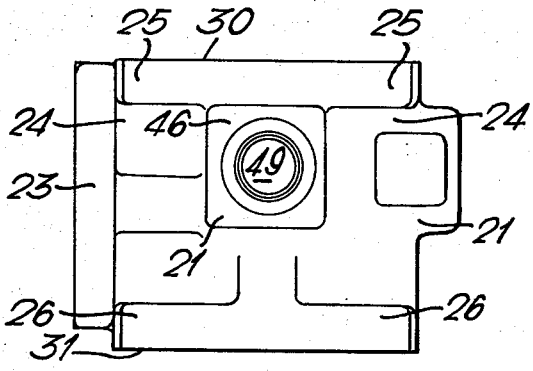
Figure 16A:
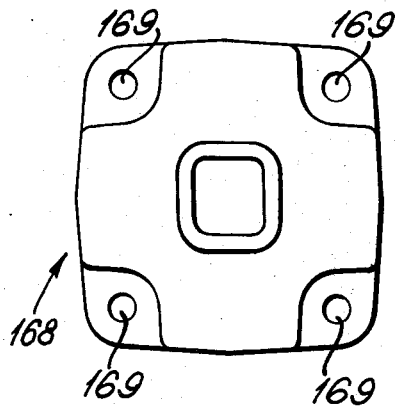
Figure 16B:
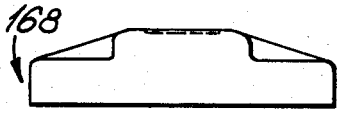
Figure 17:
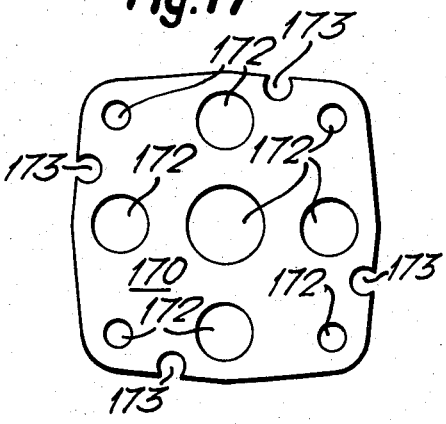
Figure 18:
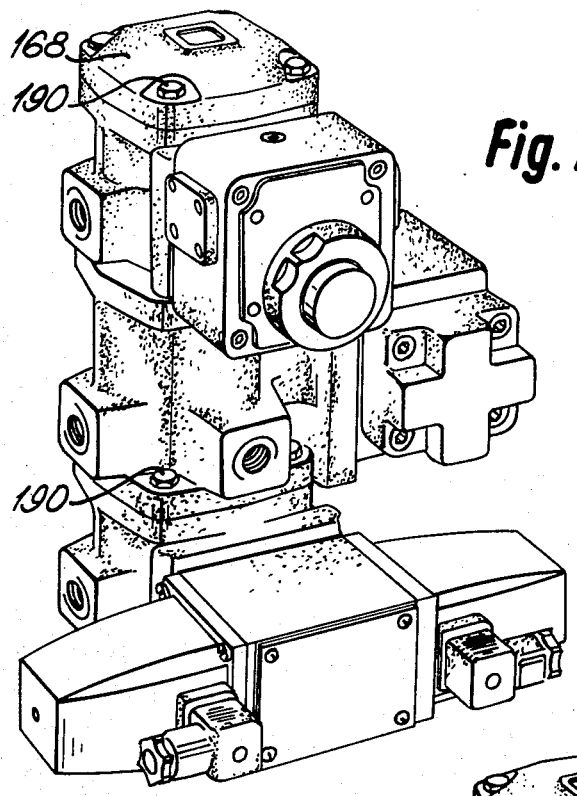
Figure 19:
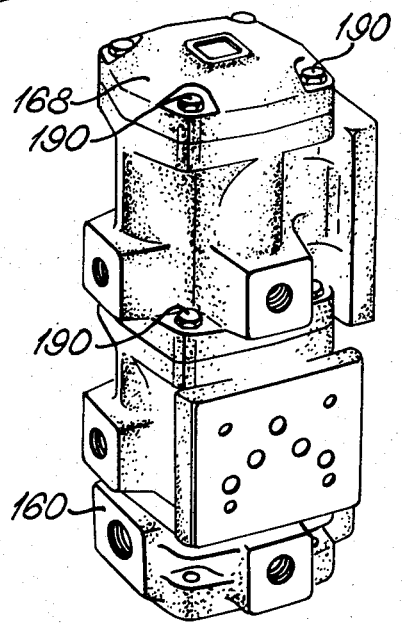
Figure 20:
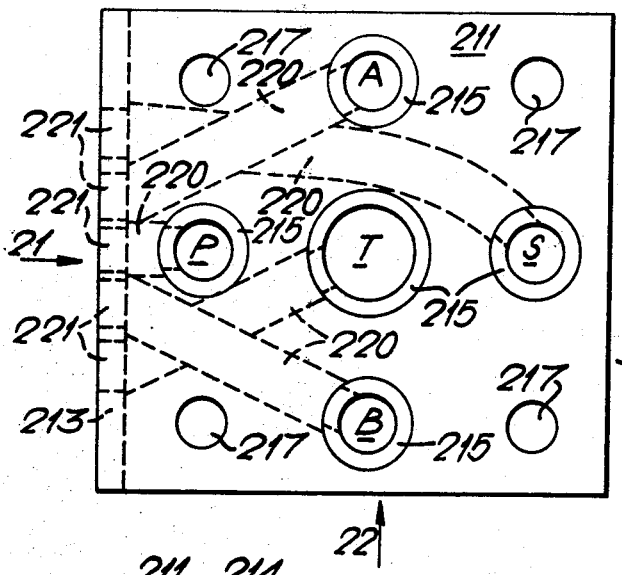
Figure 21:
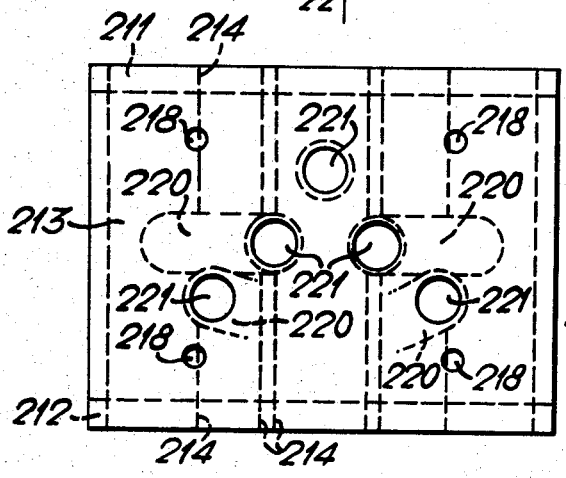
Figure 22:
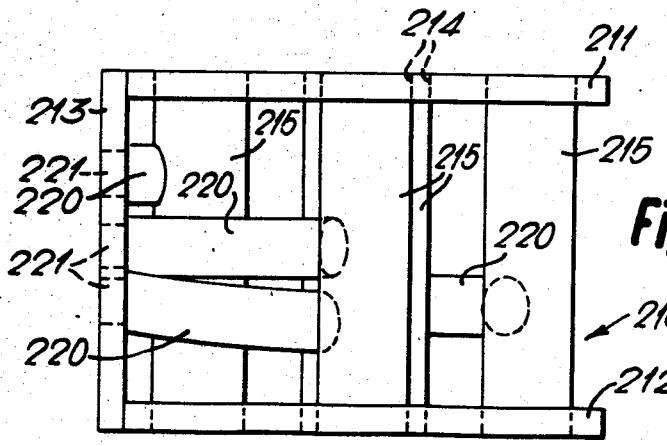

FIGS. 16*a* and 16*b* are respectively a plan view and an elevation of a cap unit;

FIG. 17 is a plan view of a sealing plate;

FIG. 18 is a perspective view of a valve stack constructed from the hydraulic circuit units of the invention;

FIG. 19 is a view similar to FIG. 18, but with the valves and the top hydraulic circuit unit removed;

FIG. 20 is a plan view of an alternative embodiment of the hydraulic circuit unit, the example shown being adapted to mount a solenoid valve; and FIGS. 21 and 22 are elevation views of the unit of FIG. 20, looking in the direction of arrows 21 and 22 respectively Referring to the drawings, FIGS. 1 to 3 show the basic hydraulic circuit units or blocks of the invention and FIGS. 4 to 12 illustrate embodiments of these blocks for mounting particular types of valves.

Each of these blocks is designed to receive a particular type of valve and each block may be stacked on another block in eight different orientations to allow very great flexibility of fluid interconnection between adjacent blocks. The blocks are particularly intended to form a modular manifold system for groups of hydraulic valves. Each block comprises parallel and flat top and bottom faces 30, 31. The blocks are generally square in plan view and each includes protruding therefrom, a boss 21 on each of three sides of the block and a plate-like portion 23 on the fourth side. The center portion 24 of each downwardly extending corner of the block is cutaway to leave flanges 25, 26 at the upper and lower end of each block and a hole 28 is drilled in each of the flanges 25, 26 for receiving a tie bolt for connecting the block to an adjacent block. The depth of the block may be selected to suit the particular valve to be mounted thereon but it is found in practice that two basic sizes will accommodate the majority of valves. These two sizes of block are illustrated in FIGS. 2 and 3 respectively and the plan view of each of these blocks is as shown in FIG. 1.

A central generally circular exhaust bore 33 is provided through the center of the block and four additional generally circular bores 34, 35, 36, 37 extend through the block spaced symmetrically around the central bore 33. All the bores are parallel and are perpendicular to the top and bottom faces of-the block.

The central bore 33 is the main exhaust or tank duct through the block and is labelled T in the drawings. Bore 34, labelled P, is the main supply duct; bore 35, labelled A, is the supply duct to the particular device which is connected to the block; bore 36, labelled S, is a spare duct, and bore 37, labelled B, is the return duct from the particular device. These bores will hereinafter sometimes be referred to by their identifying letters.

Each of the bores 35, 36, 37 is preferably connected to an orifice in the face of the boss nearest to it, the faces labelled 44, 45, 46 respectively, by a drilled and tapped hole. The tapped holes, 47, 48, 49 respectively, which are preferably all of identical configuration and are formed in the center of the respective faces 44, 45, 46 of the block, may be sealed off by a plug when not required in a particular hydraulic circuit.

Each bore 33, 35, 36 and 37 has an enlarged portion along part of its length forming a gallery 13, 15, 16, 17 respectively, as shown by dotted lines in FIG. 1, the galleries being provided to facilitate the drilling of connection passages to the bores as will be described below.

The portion 23 of each block has a side-face 40 which is machined to provide a seating for a valve assembly which is to be mounted on the block. As is illustrated in FIGS. 4 to 12, each side face 40 includes four holes 42 which are drilled in the face 40 and are tapped to receive retaining bolts for fastening the valve to the face 40. In certain cases, (not illustrated) there may six or more holes 42, depending on the particular valve to be fixed to the unit.

The features described above are common to each block shown in FIGS. 1 to 12. Further connecting passages are also drilled in the blocks, connecting two or more of the five bores to orifices in the face 40 or other faces of the block as required for the particular type of valve which is to be attached to the face 40 of the block. The bore of each such passage formed in the block is selected to be suitable for the particular valve that is to be mounted on the block. For each particular type of valve, its connections for service passages are standardized by international agreement in the hydraulics industry and the lay-out of the orifices in the face 40 in a particular block is thus suitable for accepting any valve of the required type, e.g. a check valve, which conforms to the international standards, although by special shaping of the face 40 other non-standardised valves may be incorporated.

FIGS. 4 to 12 illustrate diagrammatically the various standard blocks of the invention, each of these blocks incorporating the features described above. The further connection passages peculiar to each particular block will now be described.

FIGS. 4*a*, *b* show a hydraulic circuit unit or block 400 suitable for mounting a 3-port flow control valve. A passage 402 drilled at an angle into the block connects the T duct to an orifice 403 in the face 40, a passage 405 connects the duct to an orifice 406 and a third passage 408 connects the A duct to an orifice 409. Two depressions 411, 412, are also formed in face 40 and, as explained above, the lay-out of holes, orifices and depression on face 40 is suitable for receiving any 3-port flow control valve conforming to the international standard.

Figure 5B:
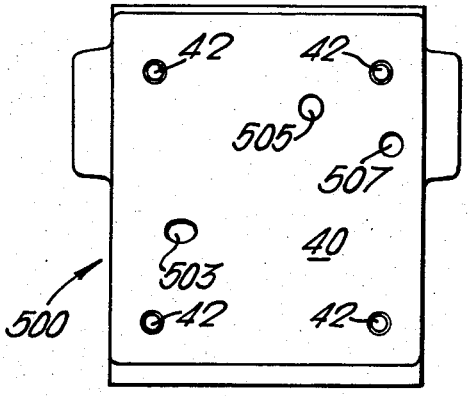

FIGS. 5*a* and 5*b* shows a block 500 for mounting a 2-port flow control valve. A passage 502 drilled at an angle into the block connects the P duct to an orifice 503 in the face 40, and a second passage 504 drilled into the block connects the B duct to an orifice 505 in the face 40. A depression 507 is formed in the face 40, and as explained above the lay-out of holes 42, orifices 503 and 505 and depression 507 on face 40 is suitable for receiving a 2-port flow control valve.

Figure 6A:
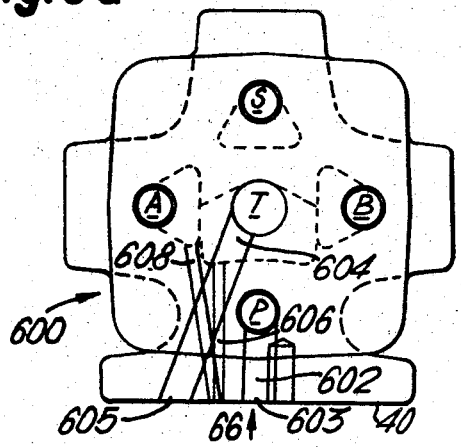
Figure 6B:
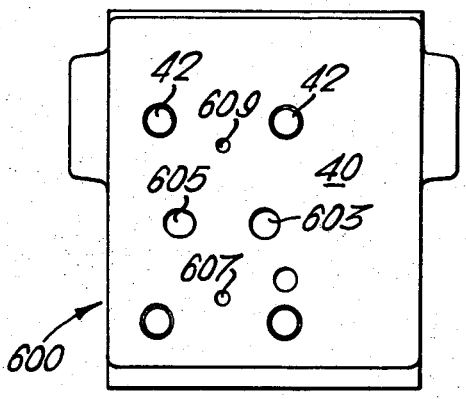

FIGS. 6*a* and 6*b* shows the connections in a relief valve unit 600. These are passages 602, 604, 606, 608 respectively connecting the P duct to orifice 603, the T duct to orifice 605, the T duct to orifice 607 and the A duct to orifice 609.

Figure 7A:
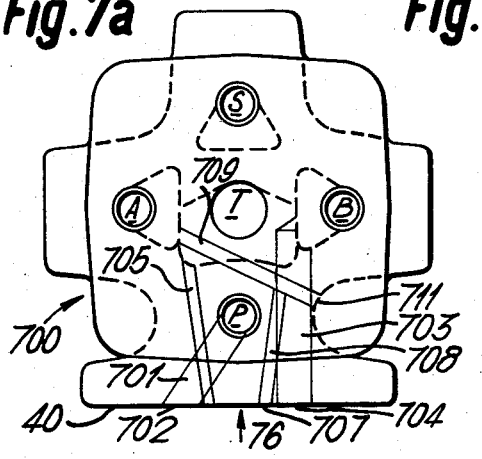
Figure 7B:
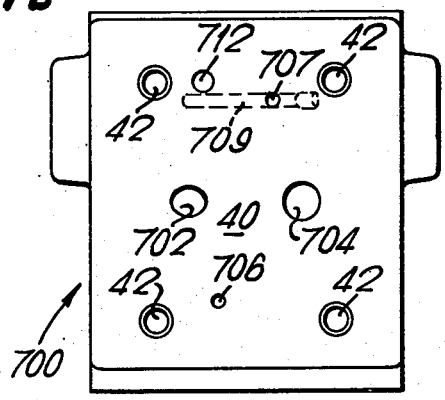

FIGS. 7*a* and 7*b* show a block 700 which is suitable for mounting a sequence valve, pilot-operated check valve or reducing valve. The connections between the various ducts or bores and the face 40 of this block are as follows. A passage 701 connects the P duct to an orifice 702 in the face 40, another passage 703 connects the B duct to an orifice 704, and a third passage 705 connects the T duct to an orifice 706.

A further orifice 707 is formed in the face 40 and this is connected by a passage 708 to a further passage 709 which connects the A duct to an orifice 711 in the side of the block. This further orifice and connected passages provide a drain which is necessary for the sequence and pilot-operated check valves. A depression 712 completes the connections on face 40 for the sequence, pilot-operated check and reducing valves.

Figure 8A:
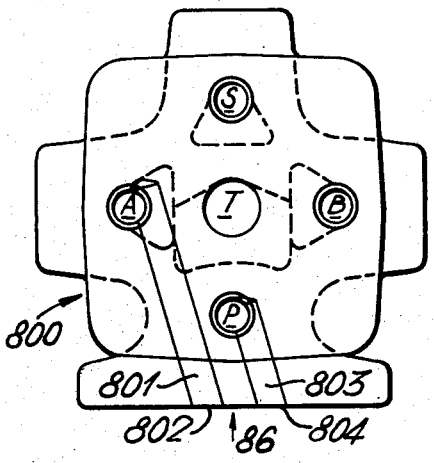
Figure 8B:
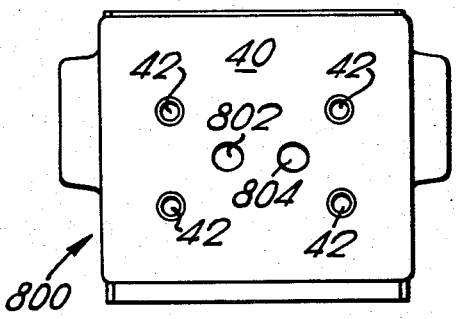

FIGS. 8*a* and 8*b* show a unit for a fine control valve, the unit 800 including a passage 801 connecting the A duct to an orifice 802 and a passage 803 connecting the P duct to an orifice 804.

Figure 9A:
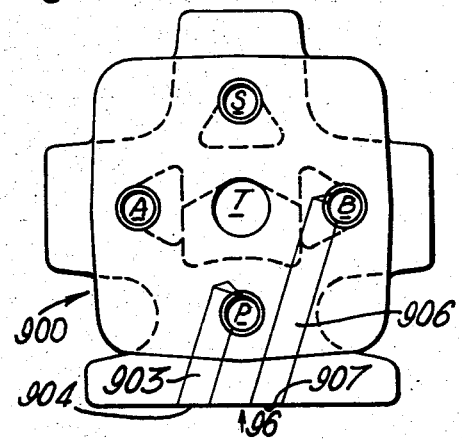
Figure 9B:
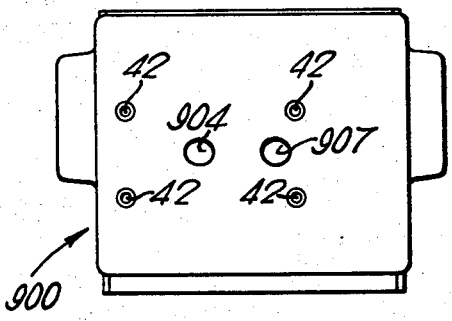

FIGS. 9*a* and 9*b* show a block 900 suitable for mounting a check valve. The connections within this block are a passage 903 connecting the P duct to an orifice 904 formed in the face 40 and a similar passage 906 connecting the B duct 37 to an orifice 907.

Figure 10A:
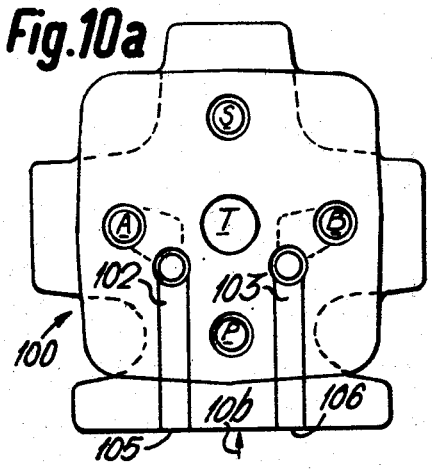
Figure 10B:
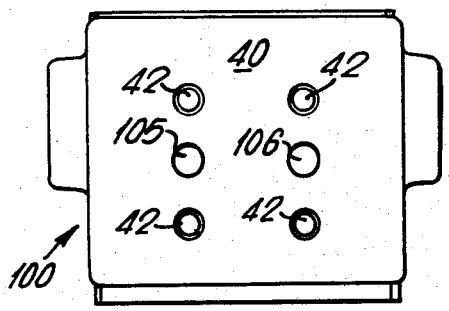

FIGS. 10*a* and 10*b* show a block 100 suitable for mounting a pilot-operated lock valve in which there are two symmetrical passages 102, 103. Passage 102 connects the A duct 35 to an orifice 105 in the face 40 and passage 103 connects the B duct 37 to an orifice 106.

Figure 11A:
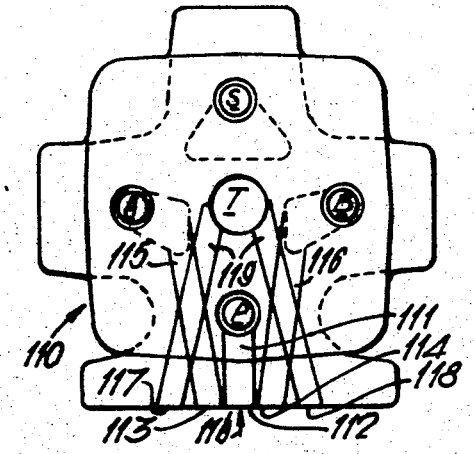
Figure 11B:
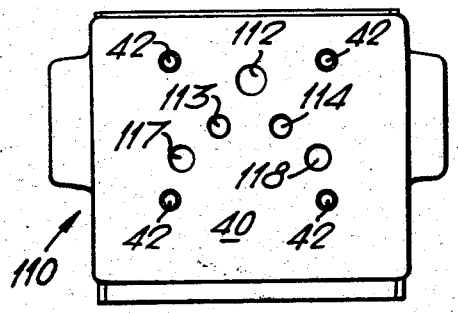

FIGS. 11*a* and 11*b* show a unit 110 for mounting a solenoid valve in a parallel circuit. A passage 111 connects the P duct 34 to an orifice 112 in the face 40 and the A duct 35 and B duct 37 are connected to orifices 113, 114 respectively by symmetrical passages 115, 116. The T duct 33 is connected to two orifices 117, 118 in the face 40 by symmetrical passages 119.

FIGS. 12*a* and 12*b* show a unit 120, similar to unit 110 and for mounting a solenoid valve in a series circuit. Like parts of units 110 and 120 have been given the same reference numerals and the passages 119 in block 110 are replaced by passages 129 connecting the orifices 117, 118 to the S duct. Units 110 and 120 are both symmetrical about a central plane through the units.

The nine blocks 400, 500, 600, 700, 800, 900 100, 110 and 120 described above are the basic hydraulic circuit units or blocks of one preferred embodiment of the invention although of course, further units may be provided for mounting specialized valves. Because of the symmetrical lay-out of the bores 33, 34, 35, 36, 37, it is possible to arrange two of the blocks adjacently in eight possible orientations. Thus, if a block is placed above another block with the faces 30 of both blocks uppermost by rotating one block about the bore 33 relative to the other block through a series of right angles the P bore may be positioned turned over so that the faces 30 of the two blocks abut, four more possible orientations of the two blocks are available.

This facility for adjusting the orientation of the blocks allows very great flexibility in the construction of hydraulic circuits using the blocks. In order to build such circuits, various other auxiliary units or blocks and associated parts are required and these are shown in FIGS. 13 to 17.

FIGS. 13*a* and 13*b* show a 90° change over block 130 which is used in a stack of blocks if it is desired to divert the fluid flow from one duct in a block to an adjacent duct in a further block above or below the first one.

The block 130 is generally octagonal in plan view and includes a main exhaust bore 133 and four further bores 134, 135, 136 and 137 of similar configuration and spacing to the bores 34, 35, 36, 37.

Tapped drillings 147, 148, 149 connect the bores 135, 136, 137 to orifices in faces 144, 145 and 146 respectively of the block 130 and a further drilling 150 connects the bore 137 to bore 134 and to an orifice 151 in a face 152 of the block.

Four holes 153 drilled through block 130 have the same spacing as holes 28 and are tapped from both ends to receive bolts for connecting the block 130 to adjacent blocks.

FIGS. 14*a* and 14*b* show a porting unit of generally similar configuration to the change-over unit 130, like parts having like reference numerals. A further tapped drilling 156 connects bore 134 to an orifice in face 157.

FIGS. 15*a*, 15*b* and 15*c* show a base unit 160. The unit 160 includes bores 161, 162, 163 and 164 corresponding to bores 33, 35, 36 and 37 and bores 162, 163 and 164 are connected to their respective faces of the block by tapped passages 47, 48, 49 similar to those shown in FIG. 1. In unit 160, however, the bores 161, 162, 163, 164 do not extend through the block, as shown in FIG. 15*c*. A main exhaust passage 166 is provided in unit 160 and connects the T bore to a tapped orifice 167. Tapped holes 28 are provided for connecting an adjacent hydraulic circuit unit to the base unit 160.

FIGS. 16*a* and 16*b* show a cap unit 168 which closes off the bores at the top of a stack of the circuit units of the invention and includes four holes 169 for connecting the cap unit to the adjacent lower unit.

FIG. 17 shows a sealing plate 170 which may be placed between each adjacent pair of circuit units to prevent leakage from the system. The plate 170 corresponds in shape to the faces 30, 31 of the units and includes holes 172 corresponding in size and lay-out to the bores 33, 34, 35, 36, 37 and holes 28 in the circuit units. The plates 170 further include circle-segment cut-outs 173, one of which is located in each edge of the plate for a purpose to be described below.

The hydraulic circuit units and auxiliary units described above may be quickly and easily assembled to form a hydraulic circuit and may be equally quickly dismantled when it is desired to alter the circuit.

An example of a completed stack of valves for a circuit is shown in FIG. 18 and FIG. 19 shows the hydraulic circuit units used in the stack with the exception of the uppermost unit. It will be seen that the stack comprises a base unit 160 and a cap unit 168 and a number of other intermediate units depending on the circuit to be constructed. As will be seen in FIGS. 18 and 19, the hydraulic circuit units are rotated relative to one another in order to achieve the desired interconnection between the valves mounted thereon. A sealing plate is interposed between each adjacent pair of units, and the units are bolted together by bolts 190. It will be realized that in constructing valve stacks such as the one illustrated in FIG. 18, not all the bores will be required to be connected at each interface in the stack and that it will therefore be necessary to plug certain of the bores. Known plugs may be used to plug the bores and the presence of a plugged bore may then be indicated by a marker disc placed in the cut-out 173 in the side of the sealing disc adjacent the plugged bore. The cut-outs are so designed that a disc retained therein will protrude slightly from the side of the stack so that the presence of plugged bores may readily be detected in order to facilitate circuit tracing.

The hydraulic circuit units described above are castings which are then drilled-to provide the desired passages in the unit. The units may however be manufactured in different ways and an example of a fabricated unit is illustrated in FIGS. 20 to 22.

A hydraulic circuit unit 210 comprises a top plate 211, a bottom plate 212 and a side plate 213 which are welded together to form a generally U-shaped frame. It will of course, be realized that although the plates have been described as 'top', 'bottom' and 'side', this refers only to the orientation of the block in the drawings and the block can be used in other orientations.

Each of the plates 211, 212 have five holes 214 drilled through it, the holes being arranged one at the center of an imaginary circle and the other four equally spaced around the circumference of the circle. The layout of the five holes is the same in each of the top and bottom plates 211, 212, and the plates are connected by five parallel pipes 215 which have their ends opening through the holes 214 and are welded to the plates around their outer edges. The five pipes or tubes 215 are utilized as follows: the central pipe T is a tank return, one opposed pair of peripheral pipes A and B are respectively the supply and return to a particular device that is to be connected to the unit, and the other opposed pair of pipes P and S are respectively the main supply and a spare.

The pipes 215 correspond to the bores 33, 34, 35, 36 and 37 described above.

Each end plate 211, 212 also includes four holes 217 through which connection means, for example, bolts may pass for connecting the unit 210 to a similar adjacent unit. The outer surface of each end plate 211, 212 is machined to facilitate sealing between units, for example, by a sealing plate and O-rings, when the units are connected together.

The side plate 213 is machined to provide a seating for a valve which is to be mounted on the block. Four holes 218 are drilled in the plate 213 for receiving retaining bolts which fasten the valve to the plate 213.

The hydraulic circuit unit 210 is completed by connection tubes 220 which extend between orifices 221 drilled in the side plate 213 and certain of the pipes 215. The pattern of the orifices 221 and the arrangement of the connection tubes 220 will depend on the particular valve unit which is intended to be attached to the circuit unit 210. In the example illustrated, the unit 210 is designed to receive a solenoid valve any may receive any face mounting type solenoid valve.

It will be realized that fabricated units corresponding to all the hydraulic circuit units described above may be produced. Furthermore, the spacing of the pipes 215 and holes 217 may be arranged so that the fabricated units are compatible with the cast units so that hydraulic circuits may be constructed from a mixture of the two types of units.

It will be seen that hydraulic circuits including valve stacks constructed from the hydraulic circuit units described above have many advantages over conventional systems. These advantages include:

(a) each block will take any standard valve of the type for which it is designed and therefore the use is not restricted to one make of valve;

(b) inter-connecting pipework between valves is virtually eliminated;

(c) several circuits may often be combined in one valve stack and by use of an adaptor plate it is possible to make a circuit comprising more than one size or flow capacity of valve;

(d) the pressure drop in the valve stack will be less than in conventional stacks;

(e) the block are extremely versatile and may be orientated in many positions with respect to each other;

(f) the stack may be quickly and easily assembled and dismantled, thus allowing prototype circuits to be built up and easily modified as necessary;

(g) valves in the stack may be removed for servicing or replacement without the necessity of dismantling the whole stack as is the case with conventional stacked valves;

(h) any solenoid valve used in the circuit may be positioned at any point in the circuit and does not need to be the top valve in a stack as is the case with conventional stacking. Thus more than one solenoid valve may be included in one stack.

The invention is not limited to the preferred embodiments described above and various modifications may be made within the scope of the invention. For example adjacent units may be fixed together by any suitable fixing means rather than bolts.

I claim:

1. A hydraulic circuit unit comprising a cast generally cubic block having, in a particular orientation thereof, parallel top and bottom faces and four side faces in mutually perpendicular planes; five mutually parallel passageways comprising bores extending between the top and bottom faces and perpendicular to said faces, said passageways being arranged with four at the corners of a square and the fifth at the intersection of the diagonals of the square; one side face perpendicular to the top and bottom faces and one of the diagonals of the square; means for attaching a valve assembly to said one side face; at least two first connections extending between said one side face and at least two of the passageways for connecting a valve assembly when attached to said one side face to said at least two passageways; a pipe opening in each of the three other side faces of the unit; a second connection extending between each pipe opening and the respective adjacent one of said four passageways; and means for connecting said unit to an adjacent similar unit in any one of eight possible relative orientations of the two units so that the passageways of the two units are aligned.

2. A hydraulic circuit comprising a base unit in the form of a block having a lower face for resting on a support surface and a parallel upper face, an orifice formed in said upper face being connected to a pipe opening in a side face of the base plate by a passageway, said pipe opening being connected to the main fluid return line in use; a first hydraulic circuit unit arranged in stacked relationship with said base unit and with said orifice in said base plate aligned with said one central passageway in said first hydraulic circuit unit; means connecting said first hydraulic circuit unit to said base unit; a valve connected to the valve mounting face of said first hydraulic circuit unit; one or more second hydraulic circuit units arranged in stacked relationship with said first hydraulic circuit and said base unit, the passageways of the or each second hydraulic circuit unit being aligned with the passageways of said first hydraulic circuit unit; means connecting the or the lowermost second hydraulic circuit unit to the first hydraulic circuit unit; a cap unit comprising a plate arranged in stacked relationship with said base unit and hydraulic units and including means closing off the passageways of the or the uppermost second hydraulic circuit unit; and means connecting said cap unit to said uppermost second hydraulic circuit unit, the or each first and second hydraulic circuit unit comprising, in a particular orientation thereof, parallel top and bottom faces, at least five passageways extending between the top and bottom faces and perpendicular to said faces, the said passageways having their ends opening through the top and bottom faces and being arranged with one passageway at the center of a circle and the other passageways equidistantly spaced around the circumference of the said circle; one side face for receiving or for attachment of a valve assembly; a plurality of first connections for extending between a valve assembly when positioned on the said one side face and at least two of the passageways; and at least three second connections, connected to three of the said other passageways respectively for connecting pipes to the said other passageways, each of the top and bottom faces of the unit being cooperable with either the top or bottom face of an adjacent similar unit so that the passageways may be aligned with the passageways of an adjacent similar unit by rotation of the unit about the center of the circle in a number of positions equal to the number of other passageways and, after inversion of the unit, the passageways may be aligned with the passageways of an adjacent similar unit in a second equal number of positions.

3. A hydraulic circuit unit comprising, in a particular orientation thereof, parallel top and bottom faces; at least five passageways extending between the top and bottom faces and perpendicular to said faces, the said passageways having their ends opening through the top and bottom faces and being arranged with one passageway at the center of a circle and the other passageways equidistantly spaced around the circumference of the said circle; one side face for receiving or for attachment of a valve assembly; a plurality of first connections for extending between a valve assembly when positioned on the said one side face and at least two of the passageways; and at least three second connections, connected to three of the said other passageways respectively for connecting pipes to the said other passageways, each of the top and bottom faces of the unit being cooperable with either the top or bottom face of an adjacent similar unit so that the passageways may be aligned with the passageways of an adjacent similar unit by rotation of the unit about the center of the circle in a number of positions equal to the number of other passageways and, after inversion of the unit, the passageways may be aligned with the passageways of an adjacent similar unit in a second equal number of positions, there being four other passageways so that eight possible orientations of the unit relative to an adjacent similar unit may be obtained, said four other passageways being arranged at the corners of a square, said one face being perpendicular to one of the diagonals of the square and there being three pipe openings, each pipe opening being arranged in a respective further side face of the unit which is perpendicular to a diagonal of the square and being connected to the respective adjacent passageway by a respective one of the second connections.

4. A hydraulic circuit unit as claimed in claim 3 in which the side valve-mounting face of the unit is perpendicular to the top and bottom faces.

5. A hydraulic circuit unit as claimed in claim 3 in which the unit comprises a cast block and the passageways and connections comprise bores formed in the block.

6. A hydraulic circuit unit as claimed in claim 3 in which the top, bottom and valve-mounting faces of the unit each comprise a plate and the passageways comprise pipes extending between the top and bottom plates and having their ends opening through the plates.

7. A hydraulic circuit comprising at least two hydraulic circuit units as claimed in claim 3 when operatively connected together.

8. A hydraulic circuit as claimed in claim 7 in which at least one of the hydraulic circuit units has a valve assembly operatively connected to its valve-mounting face.

9. A hydraulic circuit as claimed in claim 7 further comprising releasable connection means for connecting adjacent units together.

10. A hydraulic circuit as claimed in claim 9 in which the releasable connection means comprise tie bolts.

11. A hydraulic circuit as claimed in claim 7 further comprising sealing means between adjacent units.

* * * * *